United States Patent [19]

Figge et al.

[11] Patent Number: 4,544,018

[45] Date of Patent: Oct. 1, 1985

[54] FEEDING DEVICE FOR INTRODUCING MOLTEN STEEL INTO TWIN-BELT CASTERS AND MODE OF OPERATION OF SUCH A FEED DEVICE

[75] Inventors: Dieter Figge; Hans Siemer, both of Essen; Gerd Artz, Ratingen; Clemens Philipp, Meerbusch, all of Fed. Rep. of Germany

[73] Assignee: Fried. Krupp Gesellschaft mit beschränkter Haftung, Essen, Fed. Rep. of Germany

[21] Appl. No.: 592,457

[22] Filed: Mar. 21, 1984

[30] Foreign Application Priority Data

Mar. 26, 1983 [DE] Fed. Rep. of Germany ..... 3311090

[51] Int. Cl.[4] ..... B22D 11/06; B22D 11/10

[52] U.S. Cl. ..... 164/481; 164/431; 164/438; 222/593; 222/606

[58] Field of Search ..... 164/427, 428, 429, 430, 164/431, 432, 433, 434, 437, 438, 439, 440, 479, 480, 481, 482, 488, 489, 490; 222/593, 604, 605, 606, 607

[56] References Cited

U.S. PATENT DOCUMENTS

| | | | |
|---|---|---|---|
| 3,709,281 | 1/1973 | Bollinger | 164/430 |
| 3,746,072 | 7/1973 | Richardson | 164/482 |
| 3,921,697 | 11/1975 | Petry | 164/481 |
| 4,487,251 | 12/1984 | Cahoon et al. | 164/475 |

FOREIGN PATENT DOCUMENTS

| | | |
|---|---|---|
| 1758960 | 4/1971 | Fed. Rep. of Germany . |
| 3009189 | 8/1981 | Fed. Rep. of Germany . |

*Primary Examiner*—Lowell A. Larson
*Assistant Examiner*—Jorji M. Griffin
*Attorney, Agent, or Firm*—Spencer & Frank

[57] ABSTRACT

In order to be able to manipulate a feeding device with which molten steel is introduced into a twin-belt caster without ingress of air in preparation for the casting process and to carefully align the feeding device and the caster to the required extent, the feeding device includes a pouring body which is mounted in its own carriage so as to be rotatable about a horizontal pivot axis, and a separately movable tundish which is connected with the pouring body via a ball joint which forms the point of separation in that the ball socket of the ball joint and the ball pivot of the ball pivot are each respectively associated with either the tundish or the pouring body. The pouring body can be arrested in the manner of a rocker in different sloped positions and can be laterally displaced in a direction transverse to its longitudinal extent.

The associated mode of operation of a feeding device equipped with a pouring body and tundish according to the apparatus of the invention comprises initially moving the spout of the pouring body between the mold walls of the twin-belt caster a few millimeters further than that corresponding to the casting position, thereafter moving the tundish in the direction toward the twin-belt caster and arresting the tundish in its casting position, and finally setting the pouring body back against the connecting surface of the tundish so as to establish an outwardly closed connection.

14 Claims, 6 Drawing Figures

FEEDING DEVICE FOR INTRODUCING MOLTEN STEEL INTO TWIN-BELT CASTERS AND MODE OF OPERATION OF SUCH A FEED DEVICE

BACKGROUND OF THE INVENTION

The present invention relates to a feeding device for introducing molten steel into twin belt casters employing mold walls which move exclusively in the casting direction, with the feeding device including a tundish which is adjustable in height and which is followed by a tubular, closed pouring body which is movable with respect to the twin-belt caster and is likewise adjustable in height, and has a spout which extends between the mold walls and produces a sealing gap with the mold walls. Of the two members that can be connected together via the pouring body—the twin-belt caster and the tundish—at least the latter is displaceable.

The present invention further relates to a mode of operation for such a feeding device for the introduction of molten steel into twin-belt casters employing mold walls that move exclusively in the casting direction wherein movement of the pouring body establishes a connection, via the pouring body, between the tundish and the twin-belt caster so as to permit casting.

According to present knowledge, at casting speeds around 10 m/minute, steel can be cast into bars having a cast cross section of about 70×180 mm only in casters in which the mold walls move along. Attempts disclosed in the past to process steel in such casters at greater casting speeds have not resulted in cast products having sufficiently good metallurgical quality.

Federal Republic of Germany published patent application DE-AS No. 3,009,189 discloses a tubular pouring body which cooperates with a rigid continuous casting mold where the pouring body serves as the feeding device for introducing the molten steel. This pouring body is in immovable connection with a tundish but it can be moved and adjusted in height with respect to the continuous casting mold via the tundish. Sealing of the annular gap between the reciprocating continuous casting mold and the pouring body projecting thereinto is effected by the generation of inductive forces in a magnetic coil which surrounds the exterior of the continuous casting mold and is also effective in the starting section of the continuous casting mold. The drawback of the prior art design is that it can be aligned with respect to the continuous casting mold only by moving and changing the height of the heavy tundish.

In the apparatus disclosed in Federal Republic of Germany laid open patent application DE-OS No. 1,758,960, the tundish is connected by way of a rigid pipe end and via a ball joint, with a rigid continuous casting mold. The movable part of the ball joint forms a short pouring body in the form of a spherical section which is supported by way of its convex surface in the concave countersurface of the pipe end. The frontal surface of the spherical section facing away from the tundish is sealingly held against an annular plate which simultaneously forms the immovable spout of the spherical section. Screws fastened to the tundish serve as pressure elements. The drawback of this known solution is that the only compensatory movement possible is a rotary motion between the tundish and the continuous casting mold. However, during the casting process, the tundish becomes hotter than the continuous casting mold, so that both parts are displaced perpendicularly with respect to one another and thus require automatic height adjustments. Such adjustment is not provided, however, and is not possible at all because of the short structural design of the pouring body.

The present invention is based on the known realization that perfect cast products can be obtained only if the molten steel can be introduced from outside into the space between the moving mold walls of the twin-belt caster without the ingress of air. It must be assured that the molten steel can not flow out of the twin belt caster in a direction opposite to the casting direction and that, in spite of sufficient tightness, the mold walls and the spout of the pouring body will not be damaged.

SUMMARY OF THE INVENTION

It is the object of the present invention to provide a feeding device for introducing molten steel from a tundish into a twin-belt caster equipped with pairs of casting belts and laterally following linked walls in the form of dam block chains, wherein, in order to avoid freezing at the beginning of casting, the feeding device includes a pouring body which can easily be preheated and which is able to compensate for changes in dimensions occurring at the tundish. Moreover, the pouring body of the metal feeding device should be movable with respect to the twin-belt caster so that, even for longer periods of casting, geometric conditions can be maintained between the spout and the mold walls surrounding it so as to assure a sufficient seal between the mold walls and the spout of the pouring body. In particular, it must be possible to maintain the most uniform possible, tight sealing gap between the above-mentioned parts that move relative to one another.

It is further object of the present invention to provide a mode of operation which permits, in a particularly favorable manner, the establishment of a connection between the tundish, the pouring body and the twin-belt caster, with all parts being easily accessible for the purpose of preheating.

The above objects are achieved according to the present invention by a feeding device which comprises: a tundish having a flow channel; a first carriage means for supporting the tundish so that it is adjustable in height and moveable toward and away from the twin-belt caster; a tubular closed pouring body having a spout whose end is shaped such that a sealing gap is produced between the end of the pouring body and the mold walls of the twin-belt caster when the end of the spout is inserted between the mold walls; a separate second carriage means disposed between the first carriage means and the twin-belt caster and likewise moveable toward and away from the twin-belt caster; means for mounting the pouring body on the second carriage means so that the pouring body is rotatable about a horizontal pivot axis oriented such that the spout is adjustable in height with respect to the caster, and so that the pouring body is laterably adjustable in a direction transverse to its longitudinal extent; and means for connecting the flow channel of the tundish to the pouring body to permit molten steel to flow from the tundish through the pouring body, with the connecting means comprising a ball joint having a ball seat or socket and a ball pivot, each forming a connecting surface and with one of these connecting surfaces being disposed on the pouring body and the other of these connecting surfaces being disposed on the tundish. Accordingly, the pouring body of the feeding device is provided with its own carriage to form a movable pouring unit which is separate from the tundish and from the twin belt caster, and is arranged in such a manner that it is not only rotatable about a horizontal pivot axis but also has sides which are adjustable transversely to its longitudinal extent.

According to another feature of the invention, the pouring body can be connected to the tundish via a ball joint whose ball socket, which forms one connecting surface, and whose ball pivot, which forms the other connecting face, are part of different members, i.e. the tundish on the one hand and the pouring body on the other hand. Thus the present invention provides the teaching of displacing the parting line between the two parts that are movable relative to one another (tundish and pouring body of the feeding device) into the ball joint. The possible mobility of the pouring body with respect to its carriage (i.e. its rotatability about a horizontal pivot axis as well the adjustability of its sides transversely to its longitudinal extent) make it possible to accurately align the outlet of the spout with respect to the connected twin belt caster. In particular, after the spout of the pouring body has been preheated, the pouring body can be moved in the direction toward the twin-belt caster in such a manner that the sealing gap or clearance between the spout and the mold walls defining a casting cavity is as uniform as possible on all sides. This gap will normally lie in an order of magnitude from 0.3 to 1 mm. In order to be able to heat the pouring body, the tundish is movable by means of a carriage that travels in a guide. The height adjustability of the tundish is preferably made possible in that the vehicle accommodating the tundish is provided with a drive and with sets of wheels which are supported at the vehicle frame by means of eccentric bushings.

The amount of possible linear movement of the pouring unit with respect to the twin belt caster and the amount of linear movement of the tundish with respect to the pouring unit are dimensioned such that the pouring body can be preheated starting at its spout and the tundish can be preheated starting from its connecting surface, by means of respective burners that can be moved into the respective areas adjacent the pouring unit and the tundish. Each burner is preferably attached to a pivot arm and is movable around a stationary axis into an operating position for the purpose of preheating and into a rest position..

According to an advantageous feature of the present invention, the pouring body is supported on its carriage in the manner of a rocker with a weight balance or compensator device. The weight compensator device preferably comprises a vertically oriented buffer which has a variable spring characteristic. Since the pouring body, which is rotatable about the horizontal pivot axis, rests on the buffer which constitutes a yielding abutment, the spout of the pouring body is able to perform compensating movements in a vertical direction within the moving mold walls, thus reducing the danger of damage to the above-mentioned parts which move relative to one another In order to facilitate alignment of the pouring body with respect to the twin-belt caster and to avoid damage during inserting of the spout, the pouring body is supportable outside its pivot axis on a sloping, arrestable eccentric member disposed on the carriage. Moreover, the underside of the pouring body is provided with a metal centering member having sloped side faces with which it can be inserted between the lateral mold walls (i.e. between the dam block chains), which form a collar projecting beyond the remaining mold walls in a direction opposite to the casting direction. By lowering the pouring body about its pivot axis by means of the sloping eccentric member so that the metal centering member automatically inserts itself, under the influence of its sloped side faces, between the projecting lateral mold walls, the pouring body is thus aligned with respect to its lateral position relative to the caster. Thereafter, the spout of the pouring body can be brought into the region of the casting cavity of the twin-belt caster without difficulty.

The point of separation between the tundish and the pouring body is preferably designed such that the latter is provided, on its side facing the tundish, with a connecting surface which is designed as a ball socket, i.e., it is concave. Correspondingly, the tundish is equipped with a connecting surface in the form of a ball pivot, i.e., it is convex.

It has been found advisable to support the connecting surfaces which constitute the separating line between the tundish and pouring body against one another by means of a sealing mass which is in a plastic state. This sealing mass has a plastic or kneadable consistency in a temperature range between about 1100° to 1500° C., and makes it possible to let the molten steel flow through the pouring body into the twin-belt caster shortly after the two connecting surfaces have been brought together. The sealing mass is composed of the following components, which are listed in the order of their percentages: $SiO_2$, $Al_2O_3$, $B_2O_3$, CaO, $Na_2O$ and $K_2O$. Preferably, a plastic sealing mass is used which has the following composition: $SiO_2$-60%; $Al_2O_3$-14%; $B_2O_3$-10%; CaO-7%; $Na_2O$-5%; and, $K_2O$-4%.

According to a further feature of the present invention, the ceramic interior lining of the pouring body is supported, via a heat insulating layer in the form of a spring element, against an externally disposed steel jacket so that the pouring body is able to perform a small amount of compensating movements with respect to the steel jacket. The advantage realized thereby is that, if necessary, the spout of the pouring body is able to adapt itself to changes in height occurring during the casting process. Such changes result because the tundish, which is suspensed from cantilever brackets takes on higher temperatures the longer the duration of the casting process, and consequently its connecting surface descends while the height position of the carriage and of the pivot axis of the pouring body remain unchanged.

Perfect alignment of the pouring body with respect to the mold walls is necessary so as to be able to pressure cast with the twin-belt caster. That means that during the casting process, the level of the melt bath in the tundish is kept continuously at a height which lies above the exit cross section of the spout. Such regulation of the level of the melt bath in the tundish has the advantage that regulation of the casting bath level within the twin-belt caster is not necessary. Pressure casting requires that the sealing gap between the spout and the moving mold walls must be kept as constant as possible which is brought about by the present invention.

A particularly favorable mode of operation for a feeding device according to the present invention for producing a connection between a tundish and a twin belt caster via a pouring body can be realized if, according to the method of the invention, the spout of the pouring body is initially inserted between the mold walls of the twin-belt caster somewhat further than the casting position, and then after the tundish has been moved into its casting position, the pouring body is brought into its casting position by setting or moving it back from the caster and against the connecting surface of the tundish to form an outwardly closed connection. The advantage of this mode of operation is that the heavy tundish is moved into its casting position and is retained there before the above-mentioned coupling is effected via the substantially lighter-weight pouring body, which has already been inserted into the twin-belt caster.

The present invention will now be described in detail with the aid of the embodiments that are illustrated in the drawings.

DETAILED DESCRIPTION OF THE PREFERRED EMBODIMENTS

Figure 1:
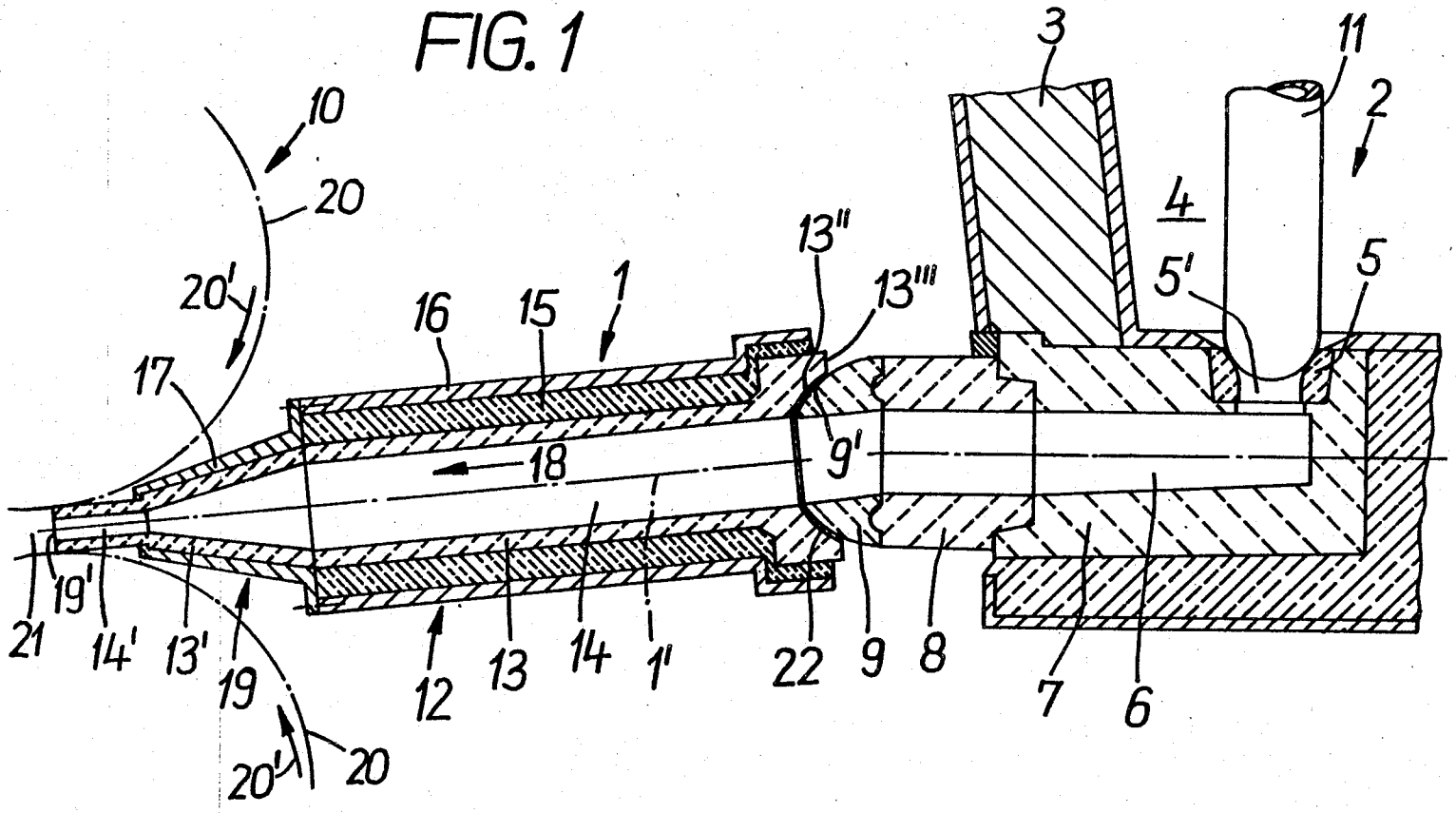
FIG. 1 is a longitudinal sectional view of the basic structure of a feeding device according to the invention including a pouring body which, in the casting position, connects a tundish with a twin-belt caster.

As shown in FIG. 1, the feeding device according to the present invention includes a tubular pouring body 1 which cooperates with a preceedingly connected tundish 2 whose melt chamber 4 is delimited by a multilayer side wall 3 and a bottom including a hearth block 5 having a bore 5' which is in communication with a bottom channel 6. The latter is defined by three successive firmly connected blocks 7, 8 and 9, of which the latter two project beyond the sidewall 3 in the manner of a collar in the direction toward the pouring body 1 and a subsequently connected twin-belt caster 10 of conventional design. The blocks 8 and 9 are fastened to each other and to the block 7 so that they are exchangeable, i.e., can be replaced.

During the casting process, molten steel is introduced from tundish 2 through bore 5' of hearth block 5 while avoiding the ingress of air. Above hearth block 5 there is provided a height adjustable plug rod 11 which is able to close bore 5' or release it for flow passage.

Figure 5:
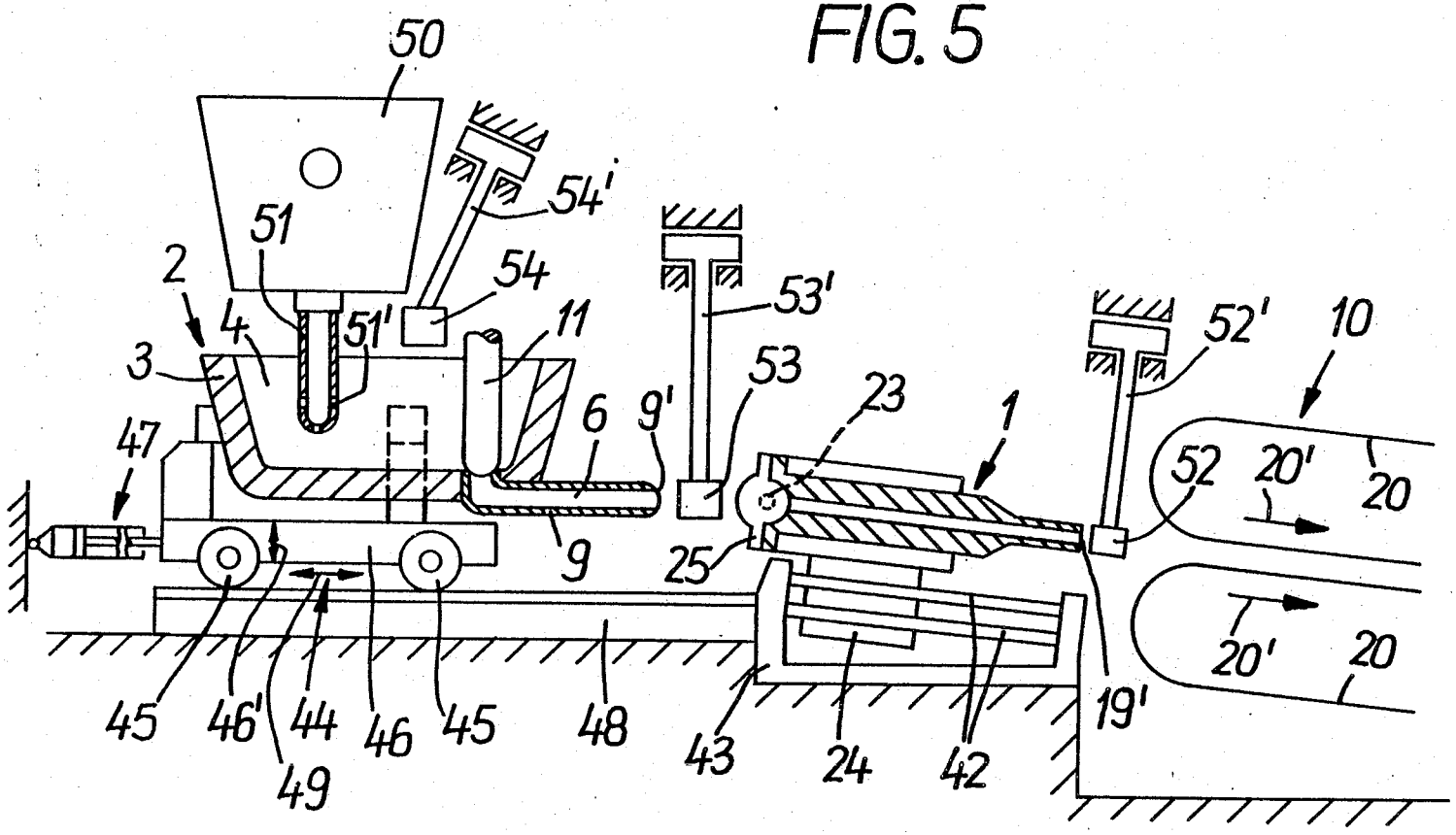
FIG. 5 is a schematic longitudinal sectional view of a feeding device according to the invention with the components in the preheating position.
Figure 6:
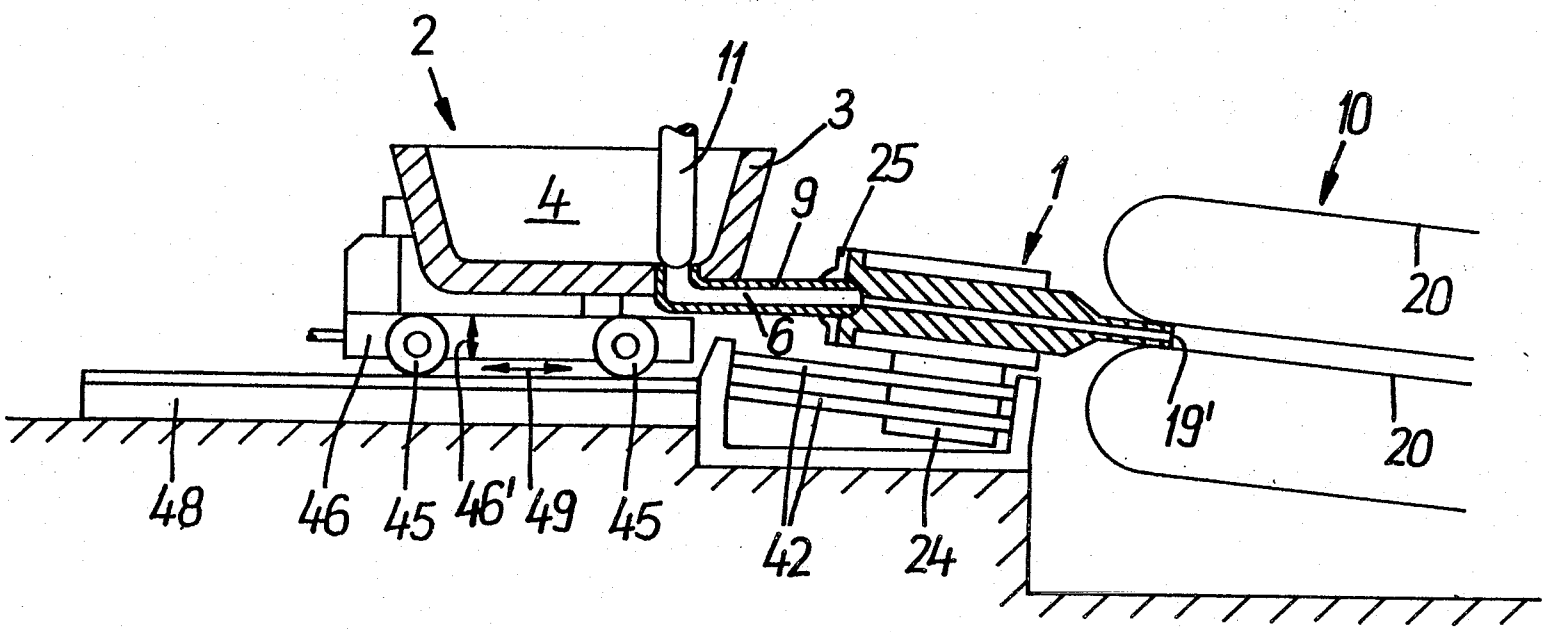
FIG. 6 is a schematic longitudinal sectional view of the feeding device shown in FIG. 5 with the components in the casting position.

Tundish 2, with the exchangeably fastened blocks 8 and 9, is movable and adjustable in height relative to the twin-belt caster 10 by means of a driven carriage (shown in FIGS. 5 and 6). The connecting end surface or face 9' of block 9 which faces the pouring body 1 is designed as a ball pivot, i.e., it is convex.

Starting section 12 of the two-part pouring body 1 has as its essential components a ceramic interior lining 13 provided with a casting bore 14 which is in communication with the bottom channel 6, a heat insulating layer 15 which surrounds the interior lining 13 toward the exterior, and a rectangular steel jacket 16 which serve as a supporting element. Heat insulating layer 15 is designed as a resilient spring element so that the ceramic lining is able to perform a small amount of heat compensating movement with respect to the external steel jacket 16.

The heat insulating layer 15 is a mixture of aluminium oxide fibres, aluminium silicate fibres and an organic binder (chemical compsition: 72% $Al_2O_3$, 21% $SiO_2$, remainder: organic binder).

The nature of the organic binder is such that it passes into the gaseous state when the temperature exceeds approx. 400° C.; the heat insulating layer's only chemical components are then $Al_2O_3$ and $SiO_2$.

At the frontal face of starting section 12 facing the twin-belt caster 10, there is provided a spout or nozzel 19 which is tapered in the casting direction (arrow 18) and which is essentially composed of a thin metal jacket 17 and a ceramic interior lining 13' provided with a partially tapered casting bore 14' and an end section which extends beyond the metal jacket 17. Metal jacket 17 preferably comprises a nickel-chromium compound including the following essential components: 73% Ni, 20% Cr, 1% Co, 5% Fe, remainder essentially: Cu, Al, Ti, C.

The end section, with its exit cross section 19', of spout 19 extends between the mold walls of the twin-belt caster 10, which walls move in the casting direction and, in a known manner, are comprised of a pair of oppositely disposed endless casting belts 20 and a pair of oppositely disposed endless dam block chains (not shown FIG. 1—see FIGS. 2 and 3) at the the sides of the belts. The above-mentioned four mold walls define a rectangular casting cavity 21 whose longitudinal axis is inclined by 6° with respect to the horizontal, as is the longitudinal axis 1' of pouring body 1. The slope of the casting cavity 21 is provided so as to be able to empty the twin-belt caster 10. The direction of movement of the casting belts 20 is indicated by arrows 20'.

On its surface 13''' facing the tundish 2, the ceramic interior lining 13 of starting section 12 is designed, in part, as a concave connecting surface 13'' which serves as the ball socket to form a ball joint with the convex connecting surface 9' of block 9 serving as a ball pivot. Connecting surface 13'' forms a separating line with connecting surface 9' by which the tundish 2 and the pouring body 1 can be connected together through the intermediary of a sealing mass 22 applied to connecting surface 9'.

This sealing mass 22 is formed of a material which has a doughy or plastic consistency in a temperature range between 1100° and 1500° C. Preferably, the sealing mass 22 is composed of $SiO_2$, $Al_2O_3$, $B_2O_3$, CaO, $Na_2O$ and $K_2O$, with the components being listed in the order of their percentages. Even more preferably, the plastic sealing mass 22 has the composition (by weight) of 60% $SiO_2$, 14% $Al_2O_3$, 10% $B_2O_3$, 7% CaO, 5% $Na_2O$ and 4% $K_2O$.

Figure 2:
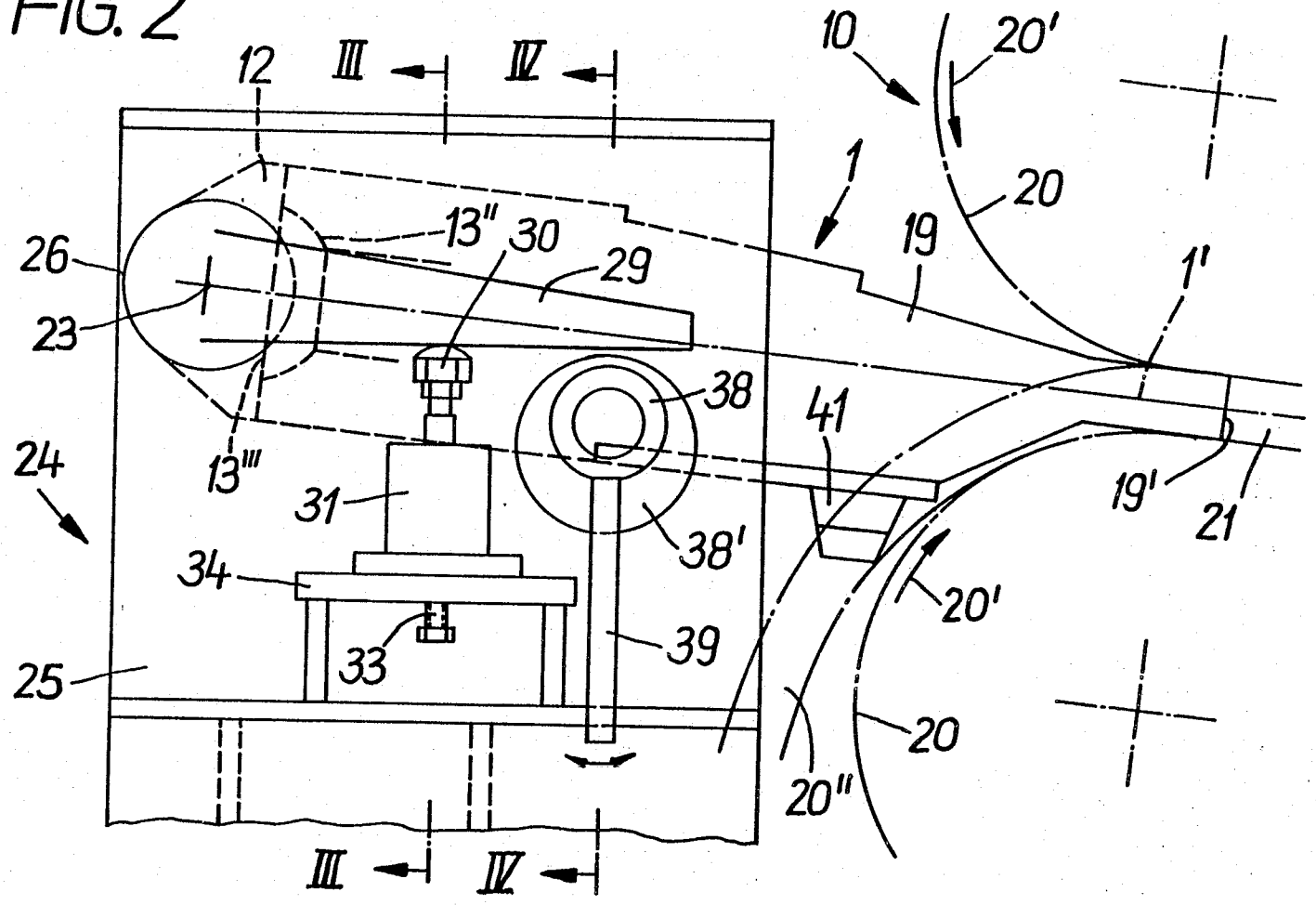
FIG. 2 is a highly schematic side view of a pouring unit according to the invention comprising essentially the pouring body carriage accommodating it.
Figure 3:
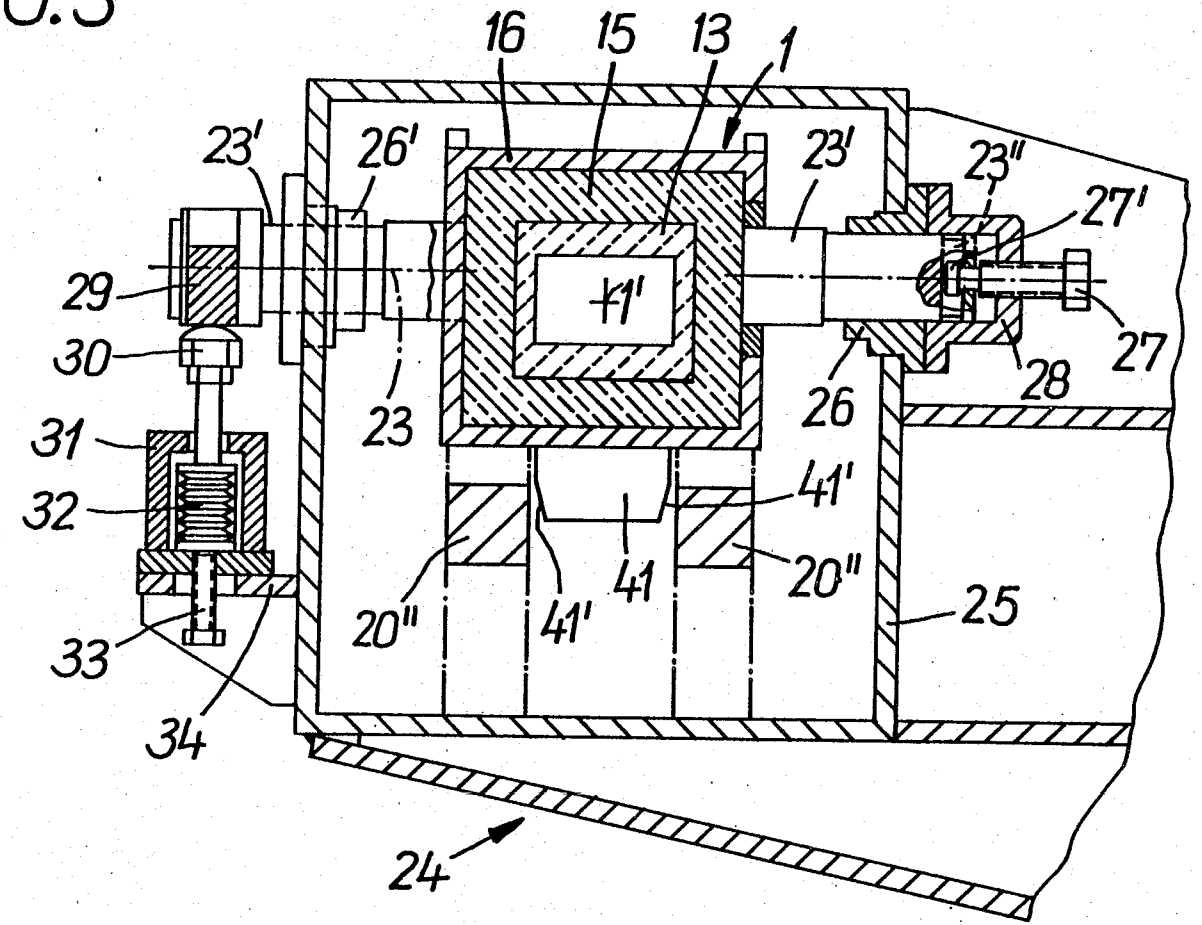
FIG. 3 is a sectional view along line III—III of FIG. 2.

As shown in FIGS. 2 and 3, pouring body 1 is mounted within an open ended rectangular housing 25 disposed on a carriage 24, so as to be rotatable about a horizontal pivot axis 23 by means of a pair of laterally extending pivot pins 23' which are journaled in respective bearing bushings 26 and 26' which, in turn are mounted in the respective opposite vertical sidewalls of the housing 25. The pouring unit, which essentially comprises the pouring body 1 and the carriage 24, is supported by a lateral guide (i.e. on the right in FIG. 3) along a guide path (see FIG. 5). Outside of the region of the bearing bushing 26, the end of the associated pivot pin 23', i.e., on the right in FIG. 3, is provided with a rectangular groove 23'' into which engages, with lateral play, the adjustment head 27' of a side adjustment screw 27. This screw 27 is itself the threadingly supported in an adjustment housing 28 that is connected with the end surface of the bearing bushing 26. By rotating the side adjustment screw 27 with respect to the adjustment housing 28, the pouring body 1 supported along pivot axis 23 by means of the pivot pins 23' can be laterally displaced within the housing 25 and can be arrested roughly in a desired lateral position. This is of significance in view of the alignment of the spout 19 (see FIG. 1) in the cold state with respect to the dam block chains 20" serving as lateral mold walls in the twin-belt caster, with these chains 20" projecting in the form of a collar, and in a direction opposite the casting direction beyond the upper and lower mold walls formed by the casting belts 20. A play of about one mm is provided for the lateral alignment in the hot state.

In order to support the pouring body 1, the latter is provided on one of its sides (see in particular FIG. 3) with a rocker arm 29 which is rigidly fastened, outside of the housing 25, to the end of the pivot pin 23' which extends through bearing bushing 26', and which rests on an elastically supported vertically oriented buffer 30. The buffer 30 is movably supported in a housing 31 via a spring element in the form of a packet of plate springs 32. The tensioning force of the spring element can be increased or decreased by means of a tensioning screw 33 threaded into the bottom of housing 31. Housing 31 is fastened to a side console 34 of housing 25. The support of the pouring body 1 in a weight compensating manner by means of a rocker arm 29 resting on a resilient vertical buffer 30 is intended to provide compensation for the different weight forces originating from the different fill levels of the pouring body 1.

Figure 4:
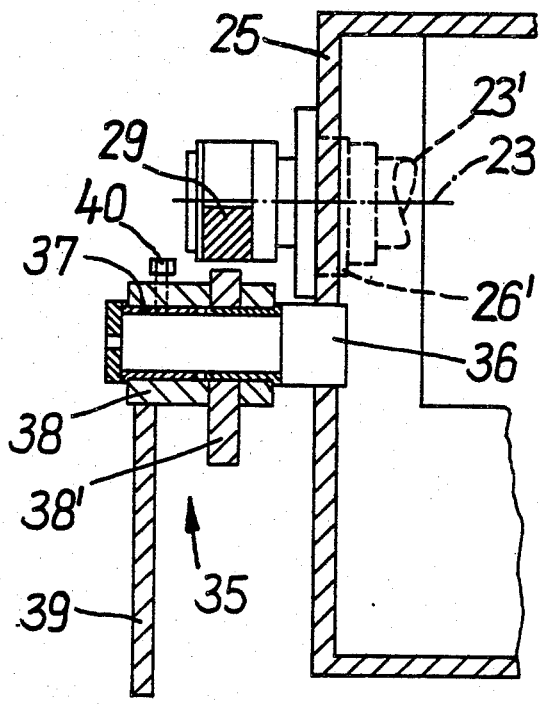
FIG. 4 is a partial sectional view along line IV—IV of FIG. 2.

As shown in FIGS. 3 and 4, on the same side of housing 25 (i.e. on the left in FIG. 3) as the rocker arm 29, a slope adjusting eccentric element 35 for the pouring body 1 is attached to the side wall of the housing 25 behind the buffer 30, when seen in the casting direction, and below the pivot axis 23. This element 35 includes, as its essential components, an immovably mounted laterally extending support arm 36, a bearing bushing 37 disposed on the arm 36, an eccentric bushing 38 including an eccentric disc 38' rotatably disposed on the bushing 37, and a lever 39 which is connected to the bushing 38 and which causes the rotational adjustment of the position of the eccentric disc 38'. Eccentric disc 38' can be brought into abutment against the lower side of the already mentioned rocker arm 29 by rotation of the bushing 38 via the lever 39.

By pivoting lever 39, either manually or by means of a setting drive, for example in the form of a hydraulic cylinder, the slope of pouring body 1 with respect to housing 25 can be infinitely varied over a wide range. The rotational position of eccentric bushing 38 with respect to supporting arm 36, and thus the slope of pouring body 1, can be secured in a simple manner by means of a set screw 40 which is threaded into member 38 and passes through members 38 and 37 to engage against supporting arm 36. The pouring body 1 of the feeding device according to the present invention thus includes, in addition to buffer 30, a slope adjustment member 35 for facilitating the inserting process of the spout 19 between the belts of the caster.

The position of the slope adjusting member 35 and of the buffer 30 with respect to housing 25 are shown particularly in FIG. 2. In the casting position, spout 19 extends at an angle of 6° into the casting cavity 21 formed by moving mold walls 20 and 20", with the longitudinal axis 1' of pouring body 1 coinciding with the longitudinal axis of the casting cavity 21.

The advantage of the above-described embodiment is that, by pivoting lever 39, pouring body 1 can initially be brought into a position which permits effortless insertion of spout 19 into the casting cavity 21. To aid in this purpose, as shown in FIGS. 2 and 3, a metal centering member 41 having finely worked, sloped side faces 41' is attached to the underside of pouring body 1. By lowering pouring body 1, the side faces 41' come into the region between the projecting lateral mold walls 20", and bring pouring body 1 into the required lateral position in which centering member 41 finally lies between mold walls 20". Thereafter, it is only necessary to move carriage 24 in the direction toward the twin-belt caster 10, i.e., toward the right in FIG. 2, to insert the end of the spout 19 into the mold cavity 21.

For the sake of better understanding, the end surface of ceramic interior lining 13 of pouring body 1 which includes the concave connecting surface 13", is shown in FIG. 2 as the line 13'''. Pivot axis 23 thus lies in front of end surface 13''', when seen in the casting direction, and thus in front of the concave connecting surface 13" which constitutes the ball socket of the ball joint formed between the pouring body 1 and the block 9 of the tundish 2. The significant fact in this connection is that the pivot point of pouring body 1, which moves in the manner of a rocker, and the center point of the ball joint ball are identical.

As can be seen in FIGS. 5 and 6, the pouring body 1 (which is shown in a simplified manner) is movably connected via housing 25 and the horizontal pivot axis 23 with the carriage 24, which itself is movable in a linear direction toward or away from the caster 10 and is supported on a stationary guide. The stationary guide essentially includes mutually guiding and parallel aligned guide rods 42 and a guide frame 43 supporting the rods 42.

With respect to mobility and adjustability of pouring body 1 relative to housing 25, the illustrated pouring body 1 is understood to be designed similarly to that of FIGS. 2 to 4.

The tundish 2 is releasably fastened on a carriage 44 whose sets of wheels 45 are equipped, in a known manner, with eccentric bushings (not shown) by means of which the wheels 45 are adjustable in height with respect to vehicle chassis 46 as indicated by the double arrow 46'. Vehicle 44 can be moved in the direction of double arrow 49 along a guide path 48 by means of a hydraulic cylinder 47 which is articulated to the vehicle as well as to the environment.

Above tundish 2, a steel pan 50 is mounted so as to be movable. During the casting process, this steel pan 50 must cooperate with tundish 2 in such a manner that the ingress of air into the steel melt from outside is guaranteed not to occur. This can be realized in a known manner in that steel pan 50 enters sufficiently deeply into the tundish 2 via an immersible pipe 51 equipped with exit openings 51', and that the level of the melt bath in the tundish 2 is covered toward the exterior by a layer of slag.

In the preheating position for the pouring body 1 and tundish 2 shown in FIG. 5, the pouring body 1, via carriage 24, and the tundish 2, via carriage 44, have each been moved toward the left to such an extent that a respective burner 52 or 53 can be pivoted into the space between twin-belt caster 10 and pouring body 1, on the one hand, and into the space between the pouring body 1 and connecting surface 9' of the tundish 2, on the other hand. By means of these burners 52 and 53, the pouring body 1 can be preheated without difficulty from the side of its exit cross section 19' and the bottom channel 6 of tundish 2 can be preheated without difficulty from connecting surface 9'.

Additionally at least one further burner 54 is associated the with tundish 2 through which the melting chamber 4 of the tundish 2 can also be preheated directly.

All of the burners 52 through 54 are mounted to be movable on pivot arms 52', 53' and 54', respectively, so that they can be moved in a direction transverse to the plane of the drawing to be brought from a rest position to the illustrated operating position.

For reasons of clarity, bottom channel 6 is shown in FIGS. 5 and 6 only as part of block 9 and its connecting surface 9'.

For the casting of steel, the feeding device according to the present invention is advisably operated as follows:

Beginning with the preheating position shown in FIG. 5, and after the heaters 52–54 have been pivoted to the rest position, the sufficiently preheated pouring body 1 is brought into a desired oblique position by rotating eccentric member 38' and then the carriage 24 is moved forward so as to permit insertion of the end of the spout 19 between the lateral mold walls 20" (i.e. between the dam block chains). Thereafter, by further moving the carriage 24, the end of the spout 19 is driven in the direction toward the twin-belt caster 10 a few millimeters further then that corresponding to the casting position shown in FIG. 6. Thus, in this intermediate position, the exit cross section 19' of spout 19 extends deeper between mold walls 20 and 20" than is necessary for proper operation.

As soon as the pouring body 1 has reached its intermediate position, the tundish 2, whose block 9 has been covered with a layer of a doughy sealing mass 22 in the region of convex connecting surface 9' which serves as the ball pivot, is moved in the direction toward pouring body 1 and is clamped in position. Then carriage 24 is set back with precision against the tundish 2 until connecting surfaces 9' and 13" are supported against one another via the layer of sealing material 22 and thus form an outwardly sealed ball joint. Immediately after formation of the connection between the pouring body 1 and the tundish 2, the casting process can be initiated by raising plug rod 11 (see FIG. 1). The seal between the end of spout 19 of pouring body 1 and mold walls 20 and 20" surrounding the spout is assured by maintaining a tight sealing gap or clearance of about 0.3 mm. The advantage realized by first bringing the pouring body 1 into an intermediate position is that the tundish 2, which has considerable mass and is consequently difficult to manipulate, can be brought into its casting position without difficulty before the lighter weight pouring body 1 is carefully moved toward the tundish 2 while avoiding damage.

The careful alignment of pouring body 1 with respect to mold walls 20 and 20" and the maintenance of the most constant narrow sealing gap or clearance is of particular significance if the steel melt is cast under pressure. In this case, the level of the melt bath within tundish 2 always is at a height which in twin-belt caster 10 lies above the exit cross section 19'. The pressure casting process requires that the seal between the pouring body 1 and the mold walls is able to withstand the increased metallostatic pressure in this region. Since pouring body 1 in the casting position is held simultaneously via its pivot axis 23 and via the ball joint with connecting surfaces 9' and 13", but since with continuing duration of casting it must be expected that the suspended tundish 2 will expand, and thus block 9 will move downwardly, it may be quite important, under certain circumstances, for the ceramic interior lining 13 in steel jacket 16 to be able to perform a compensatory movement against the resilient heat insulation layer 15.

It will be understood that the above description of the present invention is susceptible to various modifications, changes and adaptations, and the same are intended to be comprehended within the meaning and range of equivalents of the appended claims.

What is claimed is:

1. In combination with a twin belt caster having mold walls which are moved exclusively in the casting direction, a feeding device for introducing molten steel into said caster comprising:

a tundish having a flow channel; a first carriage means for supporting said tundish so that it is adjustable in height and moveable toward and away from said twin-belt caster; a tubular closed pouring body having a spout whose end is shaped such that a sealing gap is produced between said end of said pouring body and the mold walls of said twin-belt caster when said end of said spout is inserted between said mold walls; a separate second carriage means disposed between said first carriage means and said twin-belt caster and likewise moveable toward and away from said twin-belt caster; means for mounting said pouring body on said second carriage means so that said pouring body is rotatable about a horizontal pivot axis oriented such that said spout is adjustable in height with respect to said caster, and so that said pouring body is laterably adjustable in a direction transverse to its longitudinal extent; and means for connecting said flow channel of said tundish to said pouring body to permit molten steel to flow from said tundish through said pouring body, said connecting means comprising a ball joint having a ball socket and a ball pivot each forming a connecting surface and with one of said connecting surfaces being disposed on said pouring body and the other of said connecting surfaces being disposed on said tundish.

2. Apparatus as defined in claim 1 wherein the extent of movement of said second carriage means with said pouring body away from said twin-belt caster and the extent of movement of said first carriage means with said tundish away from said second carriage means are at least sufficient that respective burners can be placed between said caster and said pouring body and between said pouring body and said tundish so that said pouring body can be preheated from its said spout, and said tundish can be preheated from its said connecting surface.

3. The apparatus defined in claim 2 further comprising: a pair of burners; and means for pivotally mounting said burners so that each of said burners is movable between a rest position and an operating position for preheating the associated one of said tundish and said pouring body.

4. The apparatus as defined in claim 1 wherein said pivot axis is disposed adjacent the end of said pouring body opposite said spout, whereby said pouring body is mounted on said second carriage means in the manner of a rocker arm; and further comprising weight compensating means, mounted on said second carriage means behind said pivot axis in the direction of casting, for supporting said pouring body during a casting process.

5. Apparatus as defined in claim 4 wherein said weight compensating means comprises a vertically oriented buffer having a variable spring characteristic and being disposed on said second carriage means below said pouring body.

6. Apparatus as defined in claim 4 wherein said twin-belt caster has a rectangular casting mold formed by four of said mold walls with the upper and lower mold walls being formed by an opposed pair of endless belts and with the lateral mold walls projecting beyond said upper and lower mold walls in the direction opposite to the casting direction; and further comprising: means for adjusting the slope of said pouring body relative to said caster to facilitate insertion of said spout into said mold, said slope adjusting means including an eccentric member, and means for rotatably mounting said eccentric member on said carriage behind said pivot axis in the casting direction, so that said eccentric member, upon rotation from a rest position, will initially contact and support said pouring body and then adjust the slope of said pouring body; and means for aligning said spout between said lateral mold walls including a metal centering member, having sloped side faces, projecting downwardly from the underside of said pouring body and insertable between said projecting portions of said lateral mold walls.

7. Apparatus as defined in claim 1 wherein said one of said connecting surfaces disposed on said pouring body comprises said ball socket.

8. Apparatus as defined in claim 7 wherein said one of said connecting surfaces is formed in the end surface of said pouring body which is opposite said spout.

9. Apparatus as defined in claim 8 wherein said pivot axis is disposed ahead of said end surface in the casting direction.

10. Apparatus as defined in claim 1 wherein said connecting surfaces support one another via a sealing mass of a material in a plastic state disposed on said connecting surfaces.

11. Apparatus as defined in claim 10, wherein said material of said sealing mass has a plastic state in a temperature range between about 1100° to 1500° C.

12. Apparatus as defined in claim 11 wherein said material of said sealing mass is essentially composed of the following components, listed in the order of their percentages: $SiO_2$, $Al_2O_3$, $B_2O_3$, CaO, $Na_2O$ and $K_2O$.

13. Apparatus as defined in claim 1 wherein said pouring body includes a ceramic interior lining which is supported via a heat insulating layer in an external steel jacket; and wherein said heat insulating layer is designed as a spring element by means of which compensatory movement can take place between said ceramic interior lining and said steel jacket.

14. A method of operating a feeding device for the introduction of molten steel into a twin-belt caster employing mold walls that are moved exclusively in the casting direction wherein said feeding device comprises:

a tundish having a flow channel; a first carriage for supporting the tundish so that it is adjustable in height and moveable toward and away from the twin-belt caster; a tubular closed pouring body having a spout whose end is shaped such that a sealing gap is produced between the end of the pouring body and the mold walls of the twin-belt caster when the end of the spout is inserted between the mold walls; a separate second carriage disposed between the first carriage and the twin-belt caster and likewise moveable toward and away from the twin-belt caster; means for mounting the pouring body on the second carriage so that the pouring body is rotatable about a horizontal pivot axis oriented such that the spout is adjustable in height with respect to the caster, and so that the pouring body is laterably adjustable in a direction transverse to its longitudinal extent; and means for connecting the flow channel of the tundish to the pouring body to permit molten steel to flow from the tundish through the pouring body, with the connecting means comprising a ball joint having a ball socket and a ball pivot each forming a connecting surface and with one of these connecting surfaces being disposed on the pouring body and the other of these connecting surfaces being disposed on the tundish; and wherein said method comprises the steps of:

with said tundish and said pouring body being in a position wherein they are disconnected from each other and from said twin-belt caster, initially moving said pouring body toward said caster so as to insert said spout between said mold walls to a position a few millimeters further than the position which would correspond to the casting position; thereafter moving said tundish in the direction toward said twin-belt caster to its casting position and arresting said tundish in its said casting position; and thereafter moving said pouring body in a direction away from said twin-belt caster a sufficient distance to cause said connecting surfaces on said tundish and said pouring body to engage so as to form an outwardly closed connection between said tundish and said pouring body.

* * * * *